US009169720B2

(12) United States Patent
Lyublinski et al.

(10) Patent No.: US 9,169,720 B2
(45) **Date of Patent: *Oct. 27, 2015**

(54) CORROSION MANAGEMENT SYSTEMS FOR VERTICALLY ORIENTED STRUCTURES

(71) Applicant: NORTHERN TECHNOLOGIES INTERNATIONAL CORPORATION, Beachwood, OH (US)

(72) Inventors: Efim Ya Lyublinski, Solon, OH (US); Yefim Vaks, Euclid, OH (US)

(73) Assignee: NORTHERN TECHNOLOGIES INTERNATIONAL CORPORATION, Beachwood, OH (US)

( * ) Notice: Subject to any disclaimer, the term of this patent is extended or adjusted under 35 U.S.C. 154(b) by 296 days.

This patent is subject to a terminal disclaimer.

(21) Appl. No.: 13/790,041

(22) Filed: Mar. 8, 2013

(65) Prior Publication Data

US 2013/0186617 A1 Jul. 25, 2013

Related U.S. Application Data

(62) Division of application No. 13/068,223, filed on May 5, 2011, now Pat. No. 8,418,757.

(60) Provisional application No. 61/343,954, filed on May 6, 2010.

(51) Int. Cl.
*E21B 41/02* (2006.01)
*E21B 27/00* (2006.01)

(52) U.S. Cl.
CPC ..... *E21B 41/02* (2013.01)

(58) Field of Classification Search
CPC ..... E21B 27/00; E21B 41/02; C09K 8/54
See application file for complete search history.

(56) References Cited

U.S. PATENT DOCUMENTS

| | | | |
|---|---|---|---|
| 2,884,067 | A | 4/1959 | Marken |
| 4,290,912 | A | 9/1981 | Boerwinkle et al. |
| 4,511,480 | A | 4/1985 | Outlaw et al. |
| 4,944,916 | A | 7/1990 | Franey |
| 4,973,448 | A | 11/1990 | Carlson et al. |
| 5,139,700 | A | 8/1992 | Miksic et al. |
| 5,154,886 | A | 10/1992 | Franey et al. |
| 5,320,778 | A | 6/1994 | Miksic et al. |
| 5,398,762 | A | 3/1995 | Stinessen |
| 5,715,945 | A | 2/1998 | Chandler |
| 5,756,007 | A | 5/1998 | Franey |
| 5,855,975 | A | 1/1999 | Miksic et al. |
| 5,959,021 | A | 9/1999 | Franey |
| 6,028,160 | A | 2/2000 | Chandler et al. |
| 6,156,929 | A | 12/2000 | Chandler et al. |
| 6,617,415 | B1 | 9/2003 | Miksic et al. |
| 6,787,065 | B1 | 9/2004 | Schapira et al. |
| 2005/0008532 | A1 | 1/2005 | Jenkins et al. |
| 2009/0151598 | A1 | 6/2009 | Reinhard et al. |

*Primary Examiner* — Catherine Loikith
(74) *Attorney, Agent, or Firm* — Hudak, Shunk & Farine Co. LPA

(57) ABSTRACT

Corrosion management systems protecting against or managing corrosion of various components in generally vertically oriented structures, that can be located one or more of aboveground and underground. The corrosion management system includes a dispenser system that dispenses at least one corrosion inhibitor to the structure desired to be protected at a plurality of different vertical heights.

11 Claims, 6 Drawing Sheets

CORROSION MANAGEMENT SYSTEMS FOR VERTICALLY ORIENTED STRUCTURES

CROSS REFERENCE

This application is a Divisional application of U.S. application Ser. No. 13/068,223, filed on May 5, 2011, which claims the priority filing date of U.S. Provisional Application Ser. No. 61/343,954 filed May 6, 2010, herein fully incorporated by reference.

FIELD OF THE INVENTION

The present invention relates to corrosion management systems protecting against or managing corrosion of various components in generally vertically oriented structures, that can be located one or more of aboveground and underground. The corrosion management system includes a dispenser system that dispenses at least one corrosion inhibitor to the structure desired to be protected at a plurality of different vertical heights. Methods for utilizing corrosion management systems and protecting structures therewith are also disclosed.

BACKGROUND OF THE INVENTION

Although a wide variety of corrosion inhibitors are known, individual corrosion inhibitors are not effective for all uses. For example, a corrosion inhibitor which is effective at low temperature, atmospheric pressure and neutral or slightly acidic conditions would not necessarily be effective at high temperature, high pressure and highly acidic conditions. The mechanism of corrosion within a system is so unique that, despite theoretical considerations, selection of corrosion inhibitors is often more experimental then deducible.

As primary oil and gas fields become depleted, deeper wells are drilled to tap new sources of petroleum and gas. Increased depth, however, poses increasingly severe corrosion problems. The conditions of, for example, deep gas and/or oil wells place great corrosive stress upon the tubing and other equipment employed in such wells due to the highly oxidizing atmospheres and extreme temperature and pressure conditions. Since, the cost of drilling wells is very expensive, the importance of effective corrosion inhibition is evident. Given the depth to which such wells need to be drilled, conventional corrosion inhibitor delivery systems may be ineffective in achieving any desired level of corrosion protection in some embodiments. Additionally, similar challenges are presented by other types of aboveground and/or underground structures such as wells, boilers, storage tanks, cisterns, septic tanks, pipes, offshore legs, etc.

Various systems are currently utilized in an attempt to provide corrosion protection in gaseous environments in different vertical structures including coatings and inhibitors. However, such coatings are generally limited by being applied on new pipes and other structures or during replacement of pipes and other structures within a structure. Precoated pipes and other structures are not protected at welded joints assembled in the field, unless an additional coating is applied after welding. For some of the above structures it is impossible at all. U.S. Pat. No. 4,511,480 describes one embodiment of an inhibitor distribution system. However, efficiency of the inhibitor continuously decreases due to the decreasing of its concentration during application and the service life of the inhibitor can be unpredictable.

Given the corrosion issues facing the various types of aboveground and/or underground structures, a system, or method, is needed to enable one to deliver, in a reliable and controlled manner, one or more corrosion inhibiting compounds to protect the one or more metal-based portions or components of an aboveground and/or underground structure.

SUMMARY OF THE INVENTION

In view of the above, it is an object of the present invention to provide a corrosion management system that protects against or manages corrosion in an aboveground structure and/or an underground structure.

A further object is to provide a corrosion management, system that includes a dispenser system that dispenses a corrosion inhibitor at a plurality of different vertical heights to a substantially vertically oriented structure.

Still another object is to provide a gravity controlled dispensing system that distributes a corrosion inhibitor at a plurality of different vertical heights to a structure.

Another object is to provide a dispensing system that dispenses a volatile liquid corrosion inhibitor composition, the dispensing system having at least two holding containers disposed at different vertical heights and operatively connected to a tank, preferably in series, but optionally in parallel, to receive the corrosion inhibiting composition therefrom, the holding containers having a portion open to the surrounding atmosphere allowing the liquid corrosion inhibitor to be dispensed therefrom, such as through volatilization.

Yet another object is to provide a dispensing system with a holding container and with wicking material connected thereto such that allows the corrosion inhibiting composition to be dispensed therefrom.

Still another object to provide a dispensing system having a central support and a solid volatile corrosion inhibitor composition operatively connected to the support at a plurality of locations along the vertical length of the support.

Yet another object of the present invention is to provide a corrosion management system including a dispensing system for one or more of a well, storage tank, cistern, septic tank, and pipe, wherein the structure to be protected is located one or more of aboveground and underground.

In one aspect a corrosion management system is described, comprising a reservoir having an inlet adapted to receive a corrosion inhibitor composition and an outlet; a first conduit having a first end connected to the outlet; a first holding container located at a vertical height below the reservoir and operatively connected to a second end of the conduit and having a compartment adapted to receive a volume of the corrosion inhibitor composition and expose the corrosion inhibitor composition to an ambient atmosphere; a second conduit having a first end connected to the first holding container for receiving overflow corrosion inhibitor composition therefrom; and a second holding container operatively connected to an outlet of the second conduit and having a compartment adapted to hold a volume of the corrosion inhibitor composition and expose the corrosion inhibitor composition to the ambient atmosphere, the second holding container located at a vertical height below the first holding container.

Another aspect is a well including a corrosion management system, comprising a casing extending a vertical distance; tubing located within the casing and extending a vertical distance; a gas-containing well space extending a vertical distance between the casing and tubing; and a corrosion management system adapted to provide a corrosion inhibitor composition to an outer surface of at least a portion of the tubing located in the well space, the corrosion management system comprising a reservoir having an inlet adapted to receive a corrosion inhibitor composition, and an outlet; a first conduit having a front end connected to the outlet; a first holding container located at a vertical height below the reservoir and operatively connected to a second end of the conduit and having a compartment adapted to receive a volume of the corrosion inhibitor composition and expose the corrosion inhibitor composition to an ambient atmosphere; a second conduit having a first end connected to the first holding container for receiving overflow corrosion inhibitor composition therefrom; and a second holding container operatively connected to an outlet of the second conduit and having a compartment adapted to hold a volume of the corrosion inhibitor composition and expose the corrosion inhibitor composition to the ambient atmosphere, the second holding container located at a vertical height below the first holding container, and wherein the at least the first holding container, second holding container, and the second conduit are located in the well space.

Yet another aspect is a corrosion management system, comprising a support connectable to a portion of a vertical structure, the support having a solid volatile corrosion inhibiting composition attached thereto.

Yet a further aspect is a method for managing corrosion within a structure, comprising the steps of obtaining a corrosion management system comprising a reservoir having an inlet adapted to receive a corrosion inhibitor composition and an outlet; a first conduit having a first end connected to the outlet; a first holding container located at a vertical height below the reservoir and operatively connected to a second end of the conduit and having a compartment adapted to receive a volume of the corrosion inhibitor composition and expose the corrosion inhibitor composition to an ambient atmosphere; a second conduit having a first end connected to the first holding container for receiving overflow corrosion inhibitor composition therefrom; and a second holding container operatively connected to an outlet of the second conduit and having a compartment adapted to hold a volume of the corrosion inhibitor composition and expose the corrosion inhibitor composition to the ambient atmosphere, the second holding container located at a vertical height below the first holding container; locating at least the first holding container, second holding container, and second conduit within a portion of a substantially vertical structure; and providing the reservoir with, a corrosion inhibiting composition and allowing the composition to flow to the first conduit, first holding container, second conduit, and second holding container.

These and other objects and advantages of the present invention will be more apparent from the accompanying description taken in conjunction with the accompanying drawings wherein, various embodiments of the invention are set forth.

BRIEF DESCRIPTION OF THE DRAWINGS

The invention will be better understood and other features and advantages will become apparent by reading the detailed description of the invention, taken together with the drawings, wherein:

FIG. 5*d* illustrates upwardly directed apertures.

FIG. 6*d* illustrates upwardly directed apertures;

DETAILED DESCRIPTION OF THE INVENTION

Figure 1:
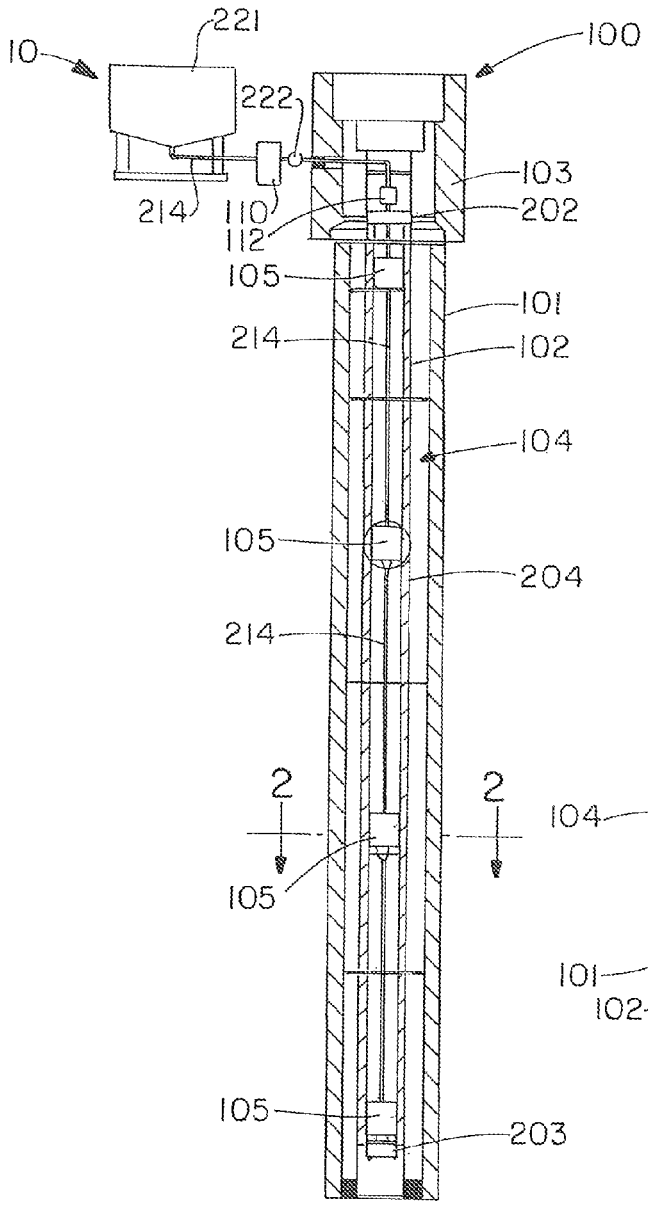
FIG. 1 is a cross-sectional, side elevational view of one embodiment of a corrosion management system of the present invention installed in a substantially vertically oriented structure.
Figure 2:
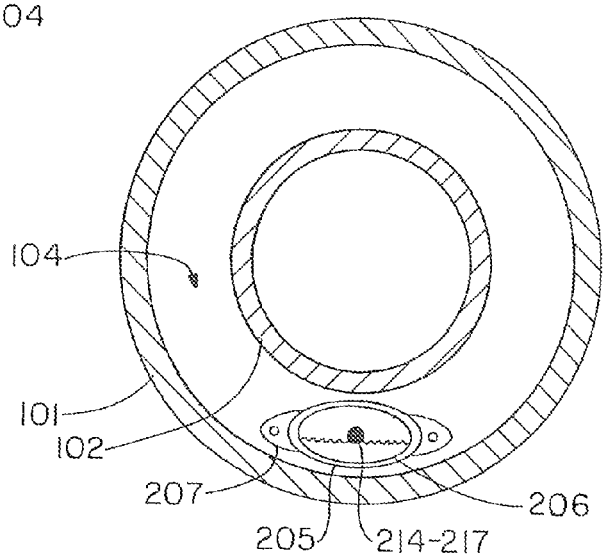
FIG. 2 is a horizontal cross-sectional view of through line A-A of FIG. 1 particularly illustrating a holding container located in a well space between a casing and tubing.

This description of useful embodiments is to be read in connection with the accompanying drawings, which are part of the entire written description of this invention. In the description, corresponding reference numbers are used throughout to identify the same or functionally similar elements. Relative terms, such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Referring now to the drawings, one embodiment of a corrosion management system 10 is shown connected to a structure 100, in particular a substantially vertically oriented structure that can be located aboveground or belowground or a combination thereof, for example partially buried. The particular structure 100 illustrated is a well having a casing 101 and well tubing 102 located therein. A wellhead 103 is located at the upper end of the structure. As known to those of ordinary skill in the art, the structure 100 can have many configurations. For example, the casing 101 and well tubing 102 can comprise a plurality of pipes, fittings, etc. A well space 104 is located between the casing 101 and tubing 102 and generally comprises gases.

As the outer surfaces of the well tubing 102 exposed in the well space 104 are subject to corrosion, it is desirable to prevent or reduce corrosion thereof using the corrosion management system 10 of the invention. The corrosion management system 10 includes at least one and preferably a plurality of dispensers that are adapted to dispense, release, or otherwise distribute a corrosion inhibitor composition, for example a holding container 105, a conduit with dispensing apertures 215A, 216A, 217A, a wick 213, volatile corrosion inhibitor containing ribbon 68 or strip 229, or sleeve 69, or a combination thereof, for example as illustrated in the various drawings. The dispensers are disposed at different vertical heights of the corrosion management system 10, and thus located at different vertical heights in relation to a vertical structure 100 the corrosion management system 10 is designed to protect.

In a useful embodiment using a liquid volatile corrosion inhibitor composition, the corrosion management system 10 includes a reservoir such as a storage or filling tank 221. The tank 221 is generally located at a vertical height above the dispensers when it is desired to use gravity to move the volatile corrosion inhibitor composition through the system. In other useful embodiments, the corrosion management system 10 can include a pump 110, etc. to provide for desired fluid flow. One or more sensors 112 can be operatively connected at various locations of the corrosion management system 10 to measure the fluid level of volatile corrosion inhibitor composition within the system, and even provide or report a signal such as to indicate the need for refilling, a blockage, etc. The volume of the tank 221 in a useful embodiment is greater than or equal to the volume of the downstream components, e.g. conduits, holding containers and wicks, when present. The tank 221 can be located inside or outside of the vertical structure 100 as desired. The tank 221 is shown lateral to the well head 103 in FIG. 1. One or more valves 222 can be present and used to control fluid flow.

A conduit 214 connects tank 221 to a first dispenser, for example a holding container 105 illustrated in FIG. 1. The conduit can be formed of generally any material that is adapted to transmit a volatile corrosion inhibitor composition to a desired location in the corrosion management system 10. In useful embodiments, the conduit is in the form of a tube, pipe, or the like. The conduit can be rigid or flexible or have segments that are rigid and flexible. In some embodiments, it is desirable to provide the volatile corrosion inhibitor composition to an area of the structure 100 between holding containers 105 or other main dispensers. As such, the conduit 214 can be provided with one or more apertures, for example as shown in FIGS. 5*b*, 5*c*, 5*d*, 6*b*, 6*c*, and 6*d*, through which the volatile corrosion inhibitor composition can exit the conduit and thus be transferred to a desired area of a structure 100. The apertures can have any desired form to accomplish volatile corrosion inhibitor dispersal. Conduit 215 illustrates substantially horizontal apertures 215A. Conduit 216 includes downwardly angled or directed apertures 216A. Conduit 217 includes upwardly angled or directed apertures 217A. The conduits 214-217 illustrated in FIGS. 6*a*-6*d* also include a sleeve 218. In a useful embodiment the sleeve is porous and allows a desired concentration of corrosion inhibitor to be dispensed between adjacent holding containers, for example that can be located at distances between 10 to 50 meters. The sleeve can include a wicking material, such as described herein.

Figure 3:
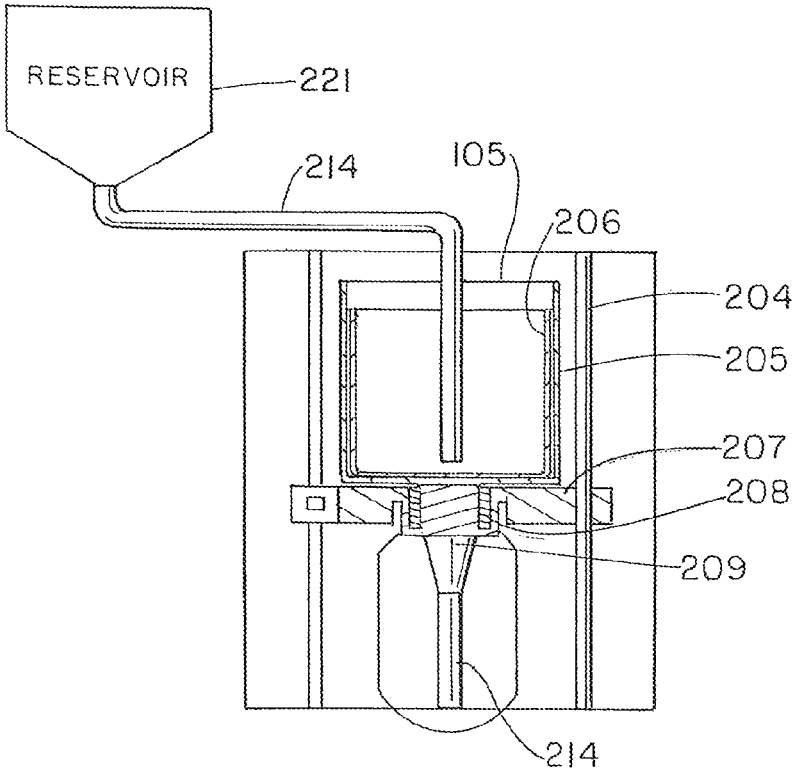
FIG. 3 is a cross-sectional view of one embodiment of a holding container of a corrosion management system wherein a first conduit has an outlet that provides a corrosion inhibiting composition to the container and a second conduit receives overflow of corrosion inhibiting composition from the holding container.

Each holding container 105 is designed to hold, a volume of a volatile corrosion inhibitor composition. In a useful embodiment, a portion of the container 105 is exposed or open to the ambient atmosphere such that some quantity of the volatile corrosion inhibitor composition can be released thereto. The containers 105 illustrated in FIGS. 3, 4, and 7 include open tops. In order to transfer the volatile corrosion inhibitor composition from one dispersing container to another at a different vertical height within the corrosion management system 10, it is desirable to provide the container 105 with an overflow transfer system. For example, in one embodiment as illustrated in FIG. 3, the container 105 comprises an inner container 206 and an outer container 205 which generally surrounds the same. The inner container 206 has a maximum volume. Volatile corrosion inhibitor composition flows from the outlet of conduit 214 into inner container 206 and fills the same. When the volume of inner container 206 is exceeded, the volatile corrosion inhibitor composition overflows into outer container 205 and then into a further conduit 214 that is located below or otherwise connected to container 105, in one embodiment, the outer container 206 has a nozzle 209 that connects to the conduit 214. A gasket 208 can be present to form a desired seal.

Figure 4:
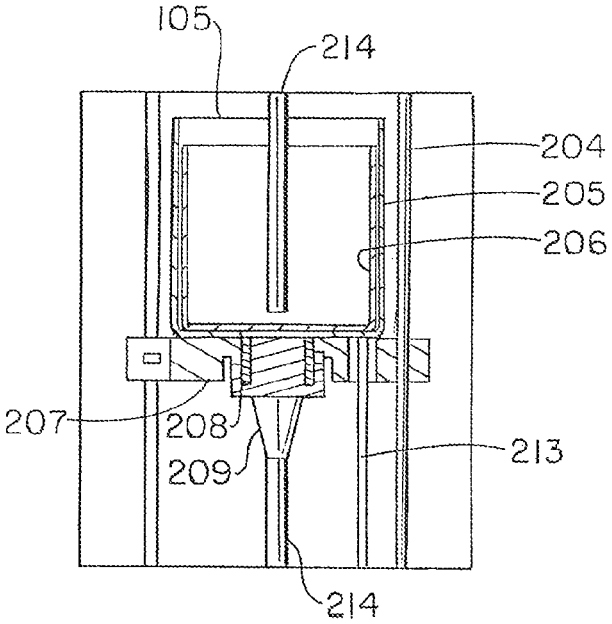
FIG. 4 is a cross-sectional, side elevational view of a further embodiment of a holding container of a corrosion management system particularly illustrating a wick extending downwardly from a portion of the container for dispensing a corrosion inhibiting composition.
Figure 5:
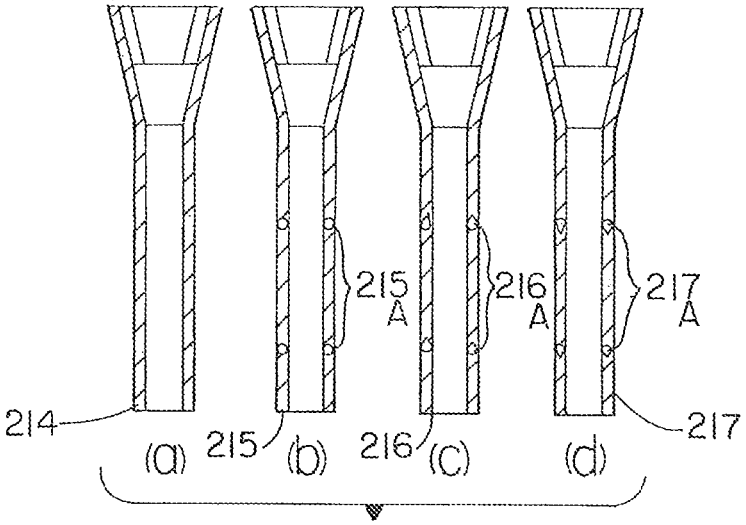
FIGS. 5*a*-5*d* represent cross-sectional, side elevational views of tubing wherein FIG. 5*a* includes no apertures, FIG. 5*b* includes horizontal apertures, FIG. 5*c* includes downwardly directed apertures.
Figure 6:
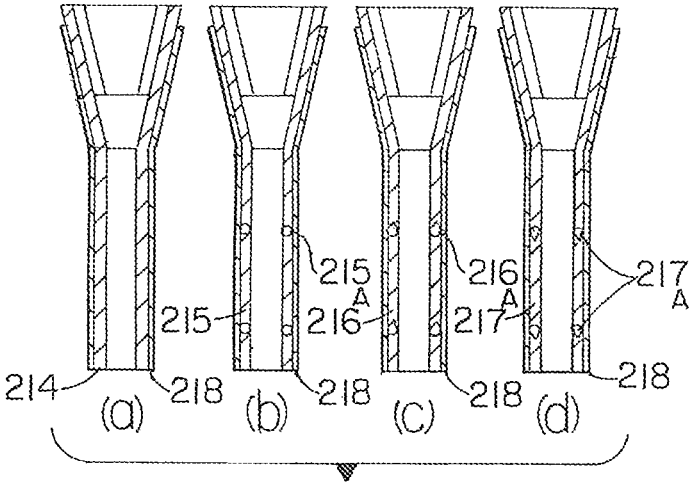
FIGS. 6*a*-6*d* represent cross-sectional, side elevational views of tubing including a sleeve wherein FIG. 6*a* includes no apertures, FIG. 6*b* includes horizontal apertures, FIG. 6*c* includes downwardly directed apertures.

In a further embodiment, a wick 213 is operatively connected to container 105, see FIG. 4 for example, and is adapted to draw volatile corrosion inhibitor composition from the container 105 and disperse it to the area surrounding the wick. In the embodiment illustrated, the wick 213 extends downwardly a vertical distance from the container 105. The length of the wick 213 can vary. The wick can be made from any material that provides for desired dispersal. Various wicking materials are known to in the art, for example woven and nonwoven materials, natural or synthetic, e.g. polymeric materials. In a useful embodiment the wick can be one or more of plastic and foam. At different levels of the system, the wick can be a combination of materials depending on the temperature at a particular location of the structure. Combinations of wicking and non-wicking materials, such as for a support, can be used. The wick can be connected to one or more of the inner container 206 and outer container 205.

Figure 7:
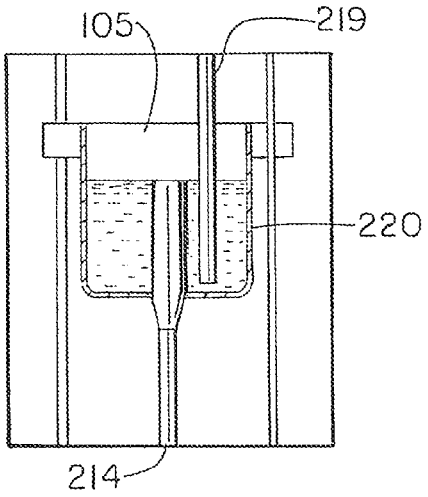
FIG. 7 is a cross-sectional, side devotional view of a further embodiment of a holding container including a corrosion inhibiting composition, wherein a portion of a conduit is located within the holding container to receive overflow of the corrosion inhibitor composition when a set volume of the holding container is exceeded.

In yet a further embodiment, see for example FIG. 7, the holding container 105 is formed as a single vessel or canister 220. A conduit 214 is connected to the canister 220 such that the conduit has an inlet located at a desired vertical height there within. The canister can be filled with the volatile corrosion inhibitor composition by an upper conduit 219 to a maximum volume as shown after which any excess volatile corrosion inhibitor composition overflows into the inlet of the conduit 214 and out of the canister 220. The conduit inlet can be positioned at a location in the canister such that a desired volume of volatile corrosion inhibitor composition can be present.

The dispensers, i.e. containers 105 and conduits 214 can be supported in or on the structure 100 by any suitable components. One dispenser can have the same or different volume than another dispenser, even if the same type, e.g. two holding containers. In a useful embodiment, a first, upper holding container has a volume less than a lower, second container, and a third container has a volume greater than the second, and so on. In a useful embodiment a cable or ladder system is used to support the dispensers. One or more cables 204 are extended along the structure, generally a portion of the vertical length thereof. A dispenser or other component of the corrosion management system 10 can be directly or indirectly connected to the cable 204, such as through a support bracket 207, which as shown in FIG. 3 is situated under container 105. In some embodiments, a weight 203 can be used to assist with proper or desired placement of the corrosion management system 10 components within the structure 100. The weight 203 can be located at the lower end, of the corrosion management system in one embodiment, such as shown in FIG. 1.

At the upper end of the corrosion management system 10, the cables 204 or other support can be connected by any suitable infrastructure to the vertically oriented structure 100, for example by a hanger bracket 202 to well head 103. If it is desired that the holding containers 105 or other dispensing devices be movable within the structure 100, the cables can advantageously be connected to a suitable winch or other height adjustment mechanism.

In view of the structure described, the corrosion management system can be utilized in one embodiment as follows. After the selected substantially vertical structure 100 is selected and assessed to determine the desired level of corrosion protection required, the corrosion management system, is assembled to include a predetermined number of dispensers. The structure 100 is then fitted with the corrosion management system 10, with the dispensers being located at different vertical heights on the structure 100, see FIG. 1 for example. The volatile corrosion inhibitor composition flows or is pumped out of the tank 221 through a conduit into a first holding container 105. Once the holding container 105 is filled, any excess volatile corrosion inhibitor composition then flows out of the container 105 and into a second container 105 located at a vertical height below the first container 105 through a further conduit 214. Each of the containers present is preferably filled with the volatile corrosion inhibitor composition. The volatile corrosion inhibitor composition is dispersed within or to one or more portions of the structure 100 along at least a vertical length thereof. As described herein, the volatile corrosion inhibitor composition can be dispersed directly from the holding container as portions thereof are exposed to the ambient atmosphere. The volatile corrosion inhibitor composition can also be dispersed from any conduit including apertures and wicks present. The tank 221 can be maintained and refilled as desired to impart a desired level or amount of volatile corrosion inhibitor composition to the structure 100.

In yet a further embodiment, the corrosion management system 10 comprises a dispenser including a solid phase volatile corrosion inhibitor composition that is directly and/or operatively connected to a structure 100, see for example FIGS. 8*a*-8*c*, 9*a*-9*b*, and 10*a*-10*c*. In a useful embodiment, the dispenser includes a support that has a solid volatile corrosion inhibitor composition attached thereto, wherein preferably the support is connected to one or more portions of the structure 100.

Figure 8A:
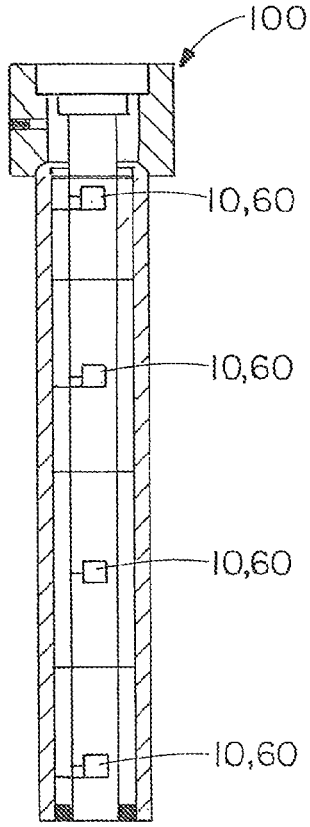
FIG. 8*a* is a cross-sectional, side elevational view of one embodiment of a corrosion management system including a plurality of dispensers located at different vertical heights within a substantially vertically oriented structure.
Figure 8B:
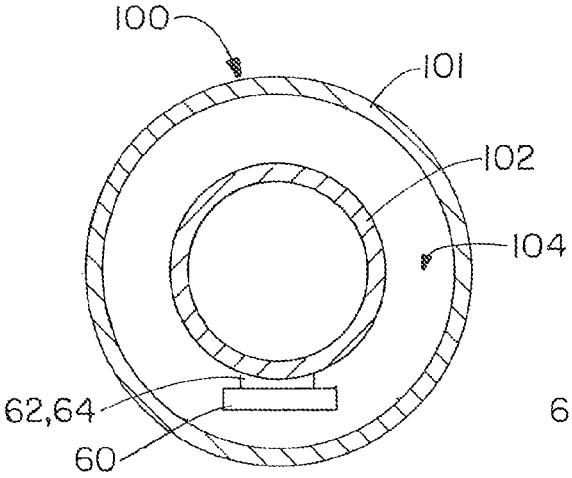
FIG. 8*b* is a cross-sectional, horizontal view of one embodiment of a dispenser of a corrosion management system operatively connected to tubing located within casing of a vertically oriented structure.
Figure 8C:
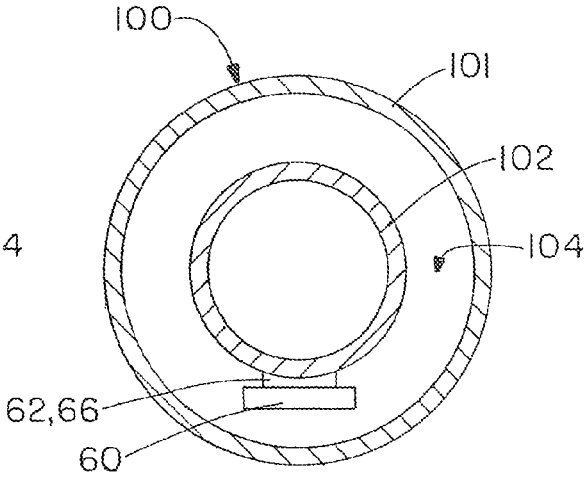
FIG. 8*c* is a cross-sectional, horizontal view of one embodiment of a dispenser or a corrosion management system operatively connected to tubing located within casing of a vertically oriented structure.

FIGS. 8*a*-8*c* illustrate a corrosion management system 10 having a plurality of supports having a solid volatile corrosion inhibitor composition 60 connected thereto. FIG. 8*a* illustrates a plurality of solid volatile corrosion inhibitor compositions 60 connected to a structure 100 at a plurality of different vertical heights along the length of the structure. As illustrated in FIG. 8*b*, the solid volatile corrosion inhibitor composition 60 is operatively connected to well tubing 102 via support 62, in particular a magnetic support 64. FIG. 8*c* illustrates solid volatile corrosion inhibitor composition 60 operatively connected to casing 101 by a support 62, in particular a strap 66 that extends around the tubing 102, generally in the form of a clamp.

Figure 9A:
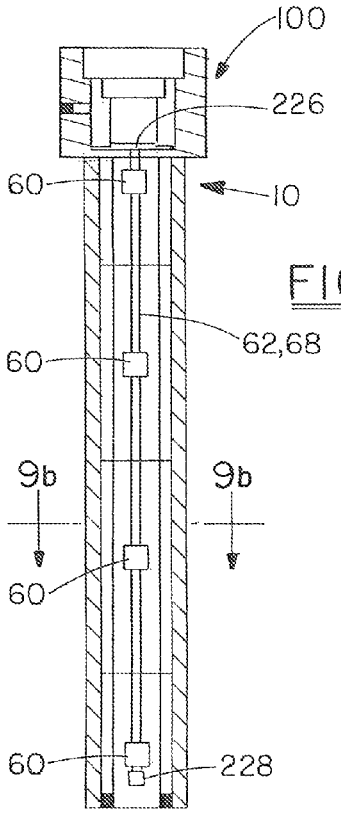
FIG. 9*a* is a cross-sectional, side elevational view of one embodiment of a corrosion management system located within a substantially vertical structure and including a dispenser having a support with a vertical length and a solid volatile corrosion inhibitor composition attached to the support at a plurality of vertical heights along the support.
Figure 9B:
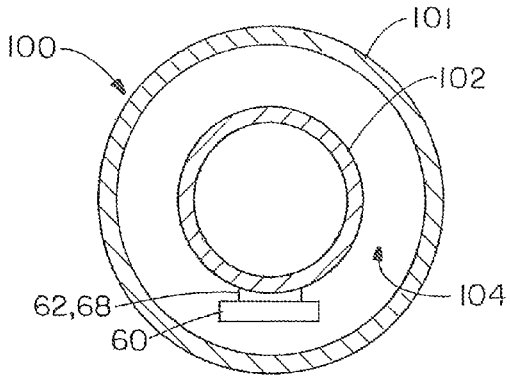
FIG. 9*b* is a cross-sectional, horizontal view through line B-B of FIG. 9A particularly illustrating one embodiment of the dispenser including a support.

FIG. 9*a* illustrates a further embodiment of a corrosion management system 10 comprising a support 62 extending along a vertical length of structure 100. At the upper end support of 62, a hanger bracket 226 is connected to a portion of the structure 100 and an elongated support 68 extends downwardly therefrom, with a plurality of devices including solid volatile corrosion inhibitor compositions 60 attached to the elongated support 68 at different vertical heights thereon in order to provide desired corrosion management to structure 100. A weight 228 is utilized to assist in lowering the corrosion management system components into the structure 100 and also aid in maintaining the system in a desired position within the structure 100. FIG. 9*b* illustrates a cross-sectional view of the embodiment illustrated in FIG. 9*a*.

Figure 10B:
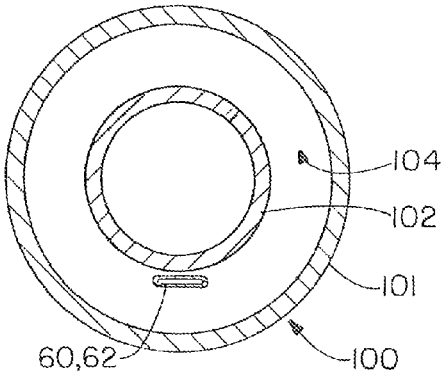
FIG. 10*b* is a cross-sectional, side elevational view particularly illustrating the dispenser of the corrosion management system as a solid volatile corrosion inhibitor strip.
Figure 10A:
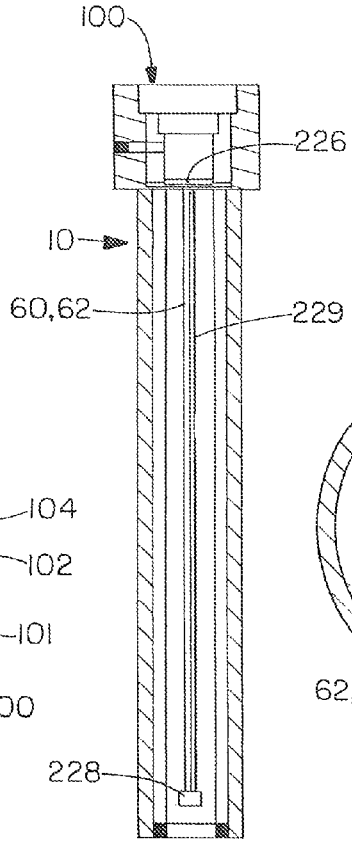
FIG. 10*a* is a cross-sectional, side elevational view of one embodiment of a corrosion management system located within a substantially vertical structure and including a dispenser having a support with a vertical length and a solid volatile corrosion inhibitor composition attached along a length of the support.
Figure 10C:
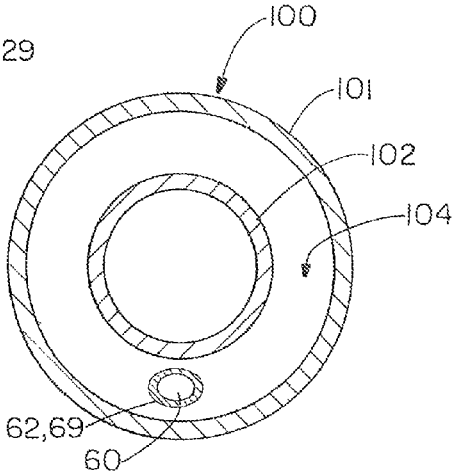
FIG. 10*c* is a cross-sectional, side elevational view particularly illustrating the dispenser of the corrosion management system as a dispenser including a porous sleeve having a volatile corrosion inhibitor powder located therein.

Yet another embodiment of the corrosion management system 10 is illustrated in FIG. 10*a*. The solid volatile corrosion inhibitor composition is extended generally along the length of a support 62 along a vertical distance of a structure 100. As in various prior embodiments, a weight 228 can be located at a lower end of the corrosion management system 10 in order to assist, installing the system within a structure 100 and/or maintaining placement of the system within the structure. FIG. 10*b* illustrates a cross-sectional view of FIG. 10*a* wherein the volatile corrosion inhibitor composition is in the form of a strip operatively connected to a support 62. FIG. 10*c* illustrates the volatile corrosion inhibitor composition in the form of a powder or pellets which are located within a sleeve 69. Sleeve 69 can be formed of generally any materials with portions thereof including pores to allow release of the corrosion inhibitor composition from the corrosion management system 10 to protect vessel 100. In a useful embodiment, a greater amount of solid volatile corrosion inhibitor composition is located at a lower end of the corrosion management system as compared to an upper end location. Stated in another manner, in one embodiment the amount of corrosion inhibitor composition increases the further the location is away from an upper end of the portion of the corrosion management system including the corrosion inhibitor composition.

Figure 11:
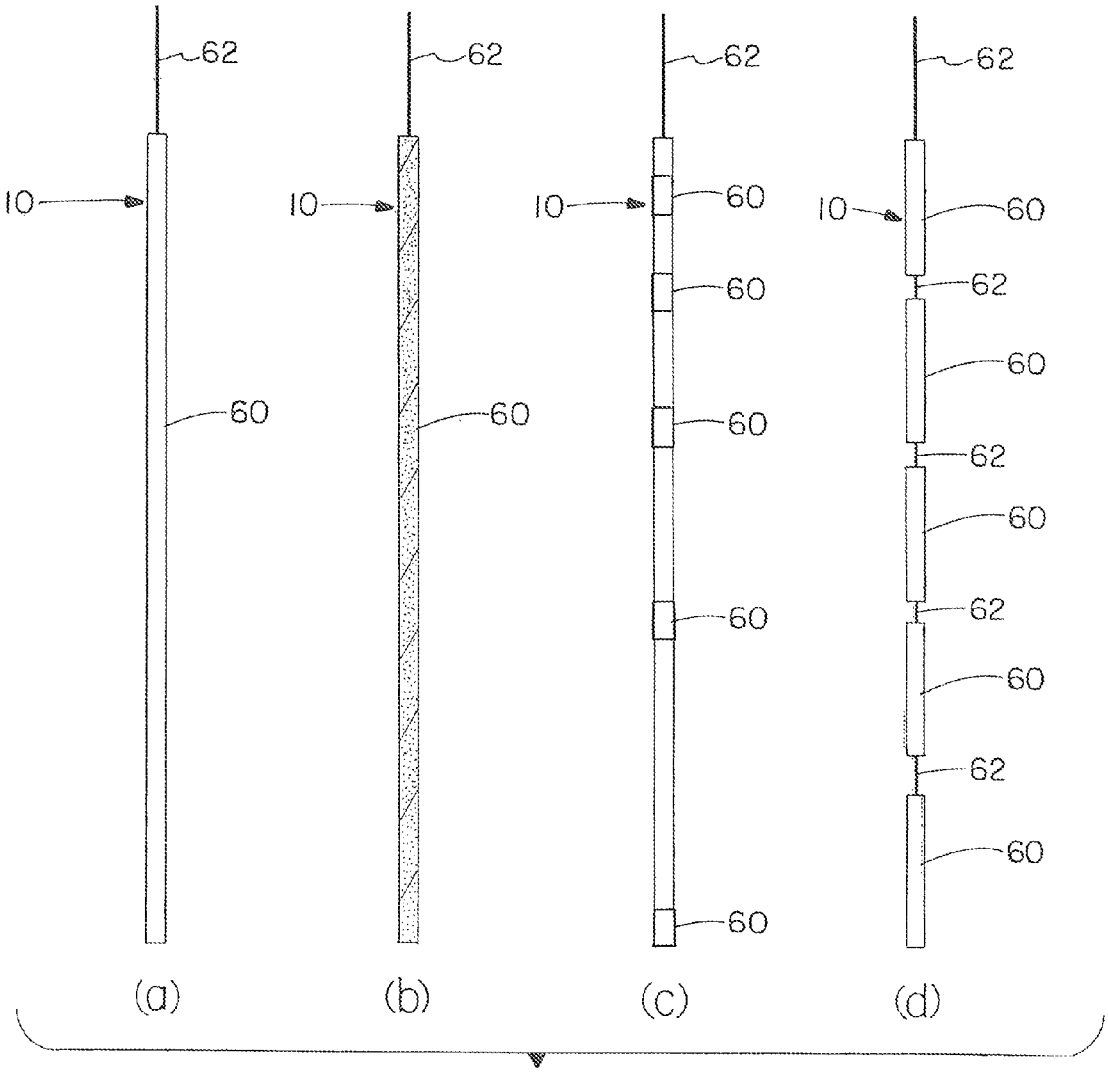
FIGS. 11*a*-11*d* illustrate side elevational views of various embodiments of corrosion management systems of the present invention including a solid-like form of a corrosion inhibitor composition.

Additional embodiments of corrosion management systems 10 are illustrated in FIGS. 11*a* through 11*d* in side elevational views. FIG. 11*a* illustrates a corrosion management system 10 including a solid corrosion inhibitor composition 60 illustrated in strip form including a polymeric component having corrosion inhibitors dispersed therein that volatilize or evaporate thereby delivering a corrosion inhibitor to desired surfaces of a structure. In a useful embodiment, the solid corrosion inhibitor composition is provided with a support 62, for example a metal wire. FIG. 11*b* illustrates a further corrosion management system 10 wherein the solid corrosion inhibitor composition 60 is in the form of a foam, woven material or sock that is impregnated with or contains therein one or more desired corrosion inhibitors. In a useful embodiment, the solid corrosion inhibitor composition is provided with a support 62, for example the woven material and a metal wire. FIG. 11*c* illustrates a plurality of separated solid corrosion inhibitor compositions 60 located at different vertical heights along the corrosion management system 10. In a useful embodiment, the solid corrosion inhibitor composition 60 is provided with a support 62, for example a metal wire. FIG. 11*d* illustrates a plurality of separated solid corrosion inhibitor compositions 60 located at different vertical heights along the corrosion management system 10. The individual solid corrosion inhibitor compositions can be the same or different than each other. In a useful embodiment, the solid corrosion inhibitor composition is provided with a support 62, for example a metal wire. The support 62 can be clearly seen located between the adjacent corrosion inhibitor composition segments.

The corrosion management systems of the present invention protect against and manage corrosion of various components of a structure that includes a vertical component, whether aboveground and/or belowground. The type of structure can vary and can include but is not limited to for example, a well a storage tank, a cistern, a septic tank, a pipe, a silo, smoke stack, cooling tower, and boiler. The corrosion management systems of the invention are particularly useful for semi-closed structures, for example fuel supply transport systems, septic systems, reservoirs, wells, etc., for example oil, natural gas, water, etc.; and/or closed systems, such as waste disposal systems. The corrosion management system can include dispensers designed to deliver at least two different phases of one or more corrosion inhibitor compositions. A semi-closed system is generally defined as a system that is opened periodically, for example to service a structure.

The corrosion management systems of the present invention can be utilized by themselves or in conjunction with one more additional systems designed to reduce or otherwise manage corrosion in at least one portion of a structure.

Additionally, as used throughout the text and claims, corrosion includes not only tarnishing, rusting and other forms of corrosion, but also includes any detrimental or unwanted degradation of an article to be protected. As such, when the phrases "corrosion inhibiting compound(s)" or composition(s) or "corrosion inhibitor(s)" are used herein, these phrases also include tarnish inhibiting compound(s) or tarnish inhibitor(s). In one embodiment, the corrosion inhibiting compound or compounds utilized in conjunction with the present invention include one or more volatile or vapor phase corrosion inhibitors, one or more soluble corrosion inhibitors, or any suitable combinations thereof.

As used throughout the text and claims, corrosion inhibitor means any compound, whether volatile or not, which inhibits at least one form of corrosion or degradation from occurring on an object to be protected. As used throughout the text and claims, a soluble corrosion inhibitor means any compound, be it solid, liquid, or gas, which is soluble in at least one liquid. As used throughout the text and claims, volatile phase corrosion inhibitor and vapor phase corrosion inhibitor are used interchangeably and both mean that such types of corrosion inhibitors are transferred to the surface of the item/article/surface to be protected by condensation of the volatile/vapor phase corrosion inhibitor's vapor on the surface of the item/article/surface to be protected.

Additionally, it should be noted that in the following text, individual range and/or ratio limits can be combined to form non-stated, or non disclosed, ranges.

In the case where the present invention utilizes a volatile or vapor phase corrosion inhibitor, any suitable volatile or vapor phase corrosion inhibitors can be used. U.S. Pat. Nos. 4,290,912; 4,944,916, 5,154,886, 5,320,778 5,756,007, 5,855,975, and 5,959,021 disclose corrosion inhibitors, for example vapor phase or volatile corrosion inhibitors, and are incorporated herein by reference in their entirety fore their teachings of such compounds. For example, useful vapor phase or volatile corrosion inhibitors include, but are not limited to, benzotriazole, and mixtures of benzoates of amine salts with benzotriazole, nitrates and nitrites of amine salts, and $C_{13}H_{26}O_2N$. Additionally, with regard to certain underground structures and/or enclosures, certain types of corrosion inhibitors are desirably used given the unique nature of the environment to be protected. Such corrosion inhibitors are known in the art (see, e.g., U.S. Pat. No. 4,511,480) and an exhaustive list is omitted herein for the sake of brevity.

The volatile corrosion inhibitors (VCI's) that are utilized in various useful embodiments are known to the art and to the literature and generally include various triazoles and derivatives thereof such as benzotriazole and tolytriazole; various benzoates such as ammonium benzoate and cyclohexylammonium benzoate; various salts of benzoic acid; various carbonates, various carbamates; various phosphates; various alkali metal molybdates such as sodium molybdate, various dimolybdates such as ammonium dimolylbdate, various amine molybdates such as aliphatic or aromatic amine having a total of from about 3 to about 30 carbon atoms, or a salt thereof; and various alkali dibasic acid salts such as set forth in U.S. Pat. Nos. 4,973,448; 5,139,700; 5,715,945; 6,028,160; 6,156,929; 6,617,415; and 6,787,065, hereby fully incorporated by reference. Useful VCI's preferably include various organic nitrites such as dicyclohexylammonium nitrite and triethanolammonium nitrite, or alkali metal nitrites such as potassium nitrite with sodium nitrite being preferred.

With respect to the various VCI components, in order to limit the amount thereof that are released over a specific period of time and form a coating on the metal to be protected against corrosion, such VCI components can be blended with various structuring compounds comprising at least one solid or pasty substance, or a liquid substance that is capable of forming when mixed with a mineral filler a solid or pasty combination. Examples of suitable structural compounds, liquid substances, and mineral fillers are set forth in U.S. Pat. No. 6,787,065 which is hereby fully incorporated by reference and include various waxes such as carnauba wax, bees wax, paraffin wax, microcrystal line wax, petrolatum, polyethylene wax oxidized microcrystalline wax, and polyethylene glycol 4000, and combinations thereof. The amount of the one or more VCI components is generally from about 1 to 90% and preferably from about 20 to about 60% by weight and the amount of the one or more structuring agents is from about 10 to about 99% by weight, and preferably from about 40 to about 80% by weight based upon the total weight of all VCI compounds and all structuring compounds.

Another group of vapor phase corrosion inhibitors that can be utilized to protect a broad range of metals such as iron, aluminum, copper, nickel, tin, chromium, zinc, magnesium, and alloys thereof as set forth in US Pub. 2009/0151598 are hereby fully incorporated by reference, and generally comprise (1) at least one $C_6$ to $C_{12}$ aliphatic monocarboxylic acid, (2) at least one $C_6$ to $C_{12}$ aliphatic dicarboxylic acid, and at least one (3) primary aromatic amide. Preferably the composition also comprises at least one (4) aliphatic ester of hydroxybenzoic acid such as 4-hydroxybenzoic acid, and/or at least one (5) benzimidazole, especially a benzimidazole substituted on the benzene ring. In a useful embodiment, the amount of component (1) is from about 1 to about 60% by weight, the amount of component (2) is from about 1 to about 40% by weight, the amount of the (3) component is from about 0.5 to about 20% by weight, the amount of the (4) component is from about 0.5 to about 20% by weight, and the amount of the (5) component is from about 5 to about 20% by weight. When utilized, this hydrophobic composition will apply a thin protective layer or film on the metal substrate or article to be protected.

As illustrated in the Figures, the systems of the present invention are designed to deliver at least one corrosion inhibitor composition. Any corrosion inhibitor can be utilized in the present invention. For example, liquid, gas, or even solid corrosion inhibitors can be utilized in conjunction, with the present invention. In another embodiment, the present invention is designed to deliver, via at least one dispenser, at least one volatile or vapor phase corrosion inhibitor. In another embodiment, the systems of the present invention are designed to deliver at least two different phases of corrosion inhibitors (i.e., gas, liquid, or solid).

It should be noted that although the Figures of the present invention illustrate certain locations for the dispensers in connection with the present invention, such locations are only exemplary. Accordingly, the dispensers of the present invention are not limited to any one location, or set of locations.

Given the above, the devices or systems of the present invention permit the release of one or more corrosion inhibitors into a desired structure over an extended period of time. The systems according to the present invention can be, if so desired, replaced and/or replenished and do not have a set life expectancy. For example, the systems of the present invention could be designed to last anywhere from about 1 month to about 50 years. In another embodiment, the life expectancy of the systems of the present invention is from about 6 months to about 25 years, from about 1 year to about 15 years, or from about 2 years to about 10 years, or even from about 3 to about 5 years. It will be apparent to one of ordinary skill in the art, upon reading the present specification, that the systems according to the present invention could be produced with an indefinite range of life expectancies. As such, the present invention is not limited to the above life expectancies. Rather, one of ordinary skill in the art would, upon reading the present specification and taking into consideration the environment in which the device will be placed, be able to design a device with a desired life expectancy.

In the Figures, the systems of the present invention are shown as tube- or pipe-like in nature. It should be noted however, that the present invention is not limited to just this arrangement and any suitable shape or orientation a structure can be utilized. The corrosion management systems can be formed from components comprising any suitable materials for example plastics, metals, or the like.

The corrosion management systems are designed to be any suitable length depending upon the depth of the substantially vertical structure to be protected. For example, individual corrosion inhibitor composition dispensers can be placed at suitable intervals depending upon the corrosion inhibition desired in a structure 100. Accordingly, there is no set spacing interval. Exemplary spacing intervals include intervals of about 1 meter, about 3 meters, about 5 meters, about 10 meters, about 20 meters, about 30 meters, about 40 meters, about 50 meters, about 75 meters, and about 100 meters. In another embodiment, the corrosion inhibitor dispensers of the present invention can be placed at any 1 meter increment between 1 and 100 meters. Given this, the overall length of system is variable and can for example be least 10 meters in one embodiment, although longer lengths of up to about 1,000 meters, about 2,000 meters, about 3,000 meters, about 5,000 meters, about 10,000 meters are within the scope of the present invention. In the case of systems having overall shorter lengths, such systems can effectively be single units. Regarding those systems of the present invention that are over about 50 meters in length, such systems can be designed to be piece-meal systems that are assembled on an ongoing basis as the system is inserted in a well.

In another embodiment, the systems of the present invention can further include electronic monitoring systems that permit the electronic control of various functions including, but not limited to, replenishment, movement control, corrosion inhibitor supply rate, etc.

In one embodiment, the corrosion management systems are designed to permit the delivery of one or more corrosion inhibitors in a radiating manner. This can be accomplished in any number of ways including, but not limited to, the use of a wick as described above to deliver one or more liquid phase corrosion inhibitors (e.g., vapor phase, or volatile, corrosion inhibitors), placing holes within one or more of the corrosion inhibitor-containing dispensers, such as a conduit to permit the delivery of one or more gaseous or liquid corrosion inhibitors.

In one embodiment, the present invention utilizes a combination of at least one liquid-phase corrosion inhibitor, which may or may not be volatile in nature, and at least one powder or solid corrosion inhibitor.

In one embodiment, the systems of the present invention are designed from any suitable material that is resistive to, or immune from, the effects of corrosion. In one embodiment, the systems, or various sub-components thereof, are selected for their resistance to corrosion, or various corrosive elements including, but not limited to, $SO_x$, $NO_x$, chlorides, oxygen, $CO_2$, HCl, water, water vapor, etc.

As is noted above, the systems of the present invention can include programmable or computerized control systems in order to permit scheduled deliveries of one or more corrosion inhibitors, or some other compound, to an underground structure. In another embodiment, the systems of the present invention have the ability to detect the level of the one or more inhibitors within the underground structure in order to determine whether or not to deliver more corrosion inhibiting compound to such a structure. In still another embodiment, the systems of the present invention have the ability to detect how much corrosion inhibiting compound to deliver to an underground structure in order to maintain a certain desired concentration of one or more, inhibitors within such a structure.

In another embodiment, the systems of the present invention permit the use of either high or low vapor pressure inhibitors at the same time. In another embodiment, the systems of the present invention permit the use of less or non-hazardous low vapor pressure inhibitors and can achieve high speed delivery of such inhibitors into a structure, such as an underground structure and/or enclosure. In still another embodiment, the systems of the present invention prevent waste of one or more corrosion inhibiting compounds by selectively delivering such compounds only when needed (e.g., as determined by a set program, as determined in response to a sensor, etc.).

Some of the advantages associated with the present invention are as follows:

(a) the systems of the present invention permit one to choose the speed of inhibitors delivery depending the vapor space volume;

(b) the systems of the present invention permit one to replace the one or more inhibitors, or inhibiting compounds, without having to take an underground structure and/or enclosure out of operation/service; and (c) the systems of the present invention can be applied to existing and/or new underground structures and/or enclosures.

Although the invention has been shown and described with respect to certain embodiments, it is obvious that equivalent alterations and modifications will occur to others skilled in the art upon the reading and understanding of this specification. In particular with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

While in accordance with the patent statutes the best mode and preferred embodiment have been set forth, the scope of the invention is not intended to be limited thereto, but only by the scope of the attached claims.

What is claimed is:

1. A well including a corrosion management system, comprising:

a casing extending a vertical distance;

tubing located within the casing and extending a vertical distance;

a gas-containing well space extending a vertical distance between the casing and tubing; and a corrosion management system adapted to provide a corrosion inhibitor composition to an outer surface of at least a portion of the tubing located in the well space, the corrosion management system comprising:

a reservoir having an inlet adapted to receive a corrosion inhibitor composition and an outlet;

a first conduit having a first end connected to the outlet;

a first holding container located at a vertical height below the reservoir and operatively connected to a second end of the conduit and having a compartment adapted to receive a volume of the corrosion inhibitor composition and expose the corrosion inhibitor composition to an ambient atmosphere;

a second conduit having a first end connected to the first holding container for receiving overflow corrosion inhibitor composition therefrom; and a second holding container operatively connected to an outlet of the second conduit and having a compartment adapted to hold a volume of the corrosion inhibitor composition and expose the corrosion inhibitor composition to the ambient atmosphere, the second holding container located at a vertical height below the first holding container, and wherein at least the first holding container, second holding container, and the second conduit are located in the well space.

2. The well including the corrosion management system according to claim 1, wherein the first holding container contains a second compartment that receives the corrosion inhibitor composition when the volume of the first compartment is exceeded, and wherein the second compartment is operatively connected to the second conduit and transfers the overflow corrosion inhibitor composition thereto.

3. The well including the corrosion management system according to claim 2, wherein the first compartment is an inner container and a second compartment is an outer container having a greater volume than the inner container.

4. The well including the corrosion management system according to claim 1, wherein the second conduit is connected to the first holding container such that when the volume of the first holding container compartment is exceeded, an excess volume of the corrosion inhibitor composition drains into the second conduit.

5. The well including the corrosion management system according to claim 1, wherein a wick is operatively connected to the compartment of the first holding container allowing the wick to extract corrosion inhibitor composition from the compartment whereby the wick can disperse the corrosion inhibitor composition outside of the holding container, the wick having a portion extending from the first holding container.

6. The well including the corrosion management system according to claim 1, wherein at least the first holding container and second holding container are supported by a cable system.

7. The well including the corrosion management system according to claim 6, wherein the cable system is adjustable and includes a mechanism for changing the vertical height of the first and second holding containers.

8. The well including the corrosion management system according to claim 1, wherein at least the second conduit includes a plurality of apertures located between the first holding container and the second holding container, and wherein the corrosion inhibitor composition can be expelled through the second conduit apertures.

9. The well including the corrosion management system according to claim 8, wherein the apertures comprise one or more of horizontal apertures, downwardly directed apertures, and upwardly directed apertures.

10. A method for managing corrosion within a structure, comprising the steps of:

obtaining a corrosion management system comprising a reservoir having an inlet adapted to receive a corrosion inhibitor composition and an outlet; a first conduit having a first end connected to the outlet; locating a first holding container in a well casing at a vertical height below the reservoir and operatively connected to a second end of the conduit and having a compartment adapted to receive a volume of the corrosion inhibitor composition and expose the corrosion inhibitor composition to an ambient atmosphere in said well casing; a second conduit having a first end connected to the first holding container for receiving overflow corrosion inhibitor composition therefrom; locating a second holding container in a well casing and operatively connected to an outlet of the second conduit and having a compartment adapted to hold a volume of the corrosion inhibitor composition and expose the corrosion inhibitor composition to the well casing ambient atmosphere, the second holding container located at a vertical height below the first holding container; and providing the reservoir with a corrosion inhibiting composition and allowing the composition to flow to the first conduit, the first holding container, the second conduit, and to the second holding container.

11. A method according to claim 10, wherein the structure includes a well space formed between an outer casing and tubing located within the casing, and wherein at least the first holding container, second holding container, and second conduit are located in the well space.

* * * * *